US007607181B1

(12) United States Patent
Harrison

(10) Patent No.: US 7,607,181 B1
(45) Date of Patent: Oct. 27, 2009

(54) MATTRESS RETAINER BLOCKS

(75) Inventor: Joshua A. Harrison, Neosho, MO (US)

(73) Assignee: L & P

( * ) Notice: Subject to any disclaimer, the term of this patent is extended or adjusted under 35 U.S.C. 154(b) by 0 days.

(21) Appl. No.: 12/359,590

(22) Filed: Jan. 26, 2009

(51) Int. Cl.
*A47C 21/00* (2006.01)

(52) U.S. Cl. ..... 5/411; 5/425

(58) Field of Classification Search ..... 5/411, 5/193, 428, 425, 617, 618, 651, 658
See application file for complete search history.

(56) References Cited

U.S. PATENT DOCUMENTS 1,031,656 A * 7/1912 Mellon ..... 5/193
2,147,538 A * 2/1939 Maguire et al. ..... 5/411
4,297,754 A 11/1981 Zuniga
4,458,371 A 7/1984 Whitehead
5,499,410 A 3/1996 Assink
5,737,783 A * 4/1998 Antinori ..... 5/411
6,070,368 A 6/2000 Anderson
7,047,579 B2 5/2006 Piana et al.

* cited by examiner

*Primary Examiner*—Alexander Grosz
(74) *Attorney, Agent, or Firm*—Shook, Hardy & Bacon LLP

(57) ABSTRACT

A mattress retainer bar attachment system is provided that includes a mattress retainer bar adapted to preserve a position of a mattress disposed on top of a mattress support. The mattress retainer bar includes a mattress retaining portion that engages the mattress and two U-shaped end portions for attaching the mattress retainer bar to the mattress support. Each of the U-shaped end portions engage an attachment block, which is secured to the mattress support and which includes a throughway for receiving a free end of the U-shaped end portions of the mattress retainer bar and a stop-surface for limiting the movement of the U-shaped end portion over the attachment block. The attachment blocks are configured such that the mattress retainer bar can be removably attached to the mattress support without using tools.

20 Claims, 3 Drawing Sheets

MATTRESS RETAINER BLOCKS

BACKGROUND

Adjustable beds are well-known to allow the user to position the bed in various configurations. Typically, adjustable beds allow at least the head and foot of the bed to be raised and lowered. The mattress of an adjustable bed is moved and supported by a mattress support, which typically includes several sections coupled to one another with hinges. Typically, an adjustment mechanism includes links that engage a head section to articulate the head of the bed and links that engage a leg section to articulate or elevate the foot of the bed. Often, when the head of the bed is articulated, the mattress has a tendency to shift toward the foot of the bed, sometimes even slipping off of the mattress support. To prevent the mattress from slipping off of the mattress support during articulation, various devices are currently used. One example of such a device is a mattress retainer bar.

Mattress retainer bars are well-known in the art and include bars having an upright mattress retaining portion that engages the foot of the mattress to prevent the mattress from sliding off the mattress support. The mattress retainer bar typically has a pair of U-shaped end portions that are roughly perpendicular to the mattress retaining portion and that are used to secure the mattress retaining bar to the mattress support. Typically, either a consumer or a technician is tasked with attaching the mattress retainer bar to the mattress support. In many cases, an attachment kit for attaching a mattress retainer bar to a mattress support can include as many as 16 pieces or more including, for example, bolts, retainers, flat washers, and cupped washers.

A typical mattress retainer bar installation includes installing a cupped washer, a spacer and a flat washer on a mattress retainer bolt and loosely installing the mattress retainer bolt into a tapped hole in the foot panel of the mattress support. This process is repeated for each of four mattress retainer bolts such that there are two bolts associated with each U-shaped end portion of the mattress retainer bar. Each U-shaped end portion is then positioned around the mattress retainer bolts and the retainer bar end portions are positioned between the spacer and the washer associated with each bolt. The bolts are then tightened to secure the mattress retainer bar in place. This installation process requires the consumer or technician to use a screwdriver and can take an unnecessary amount of time. Additionally, the mattress retainer bar attachment kits provide the consumer or technician with 16 or more pieces of hardware to potentially misplace during assembly.

SUMMARY

The invention is defined by the claims below. This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention relate to a mattress retainer bar attachment system that includes attachment blocks secured to the mattress support and configured so that a mattress retainer bar can be attached by a consumer or technician without the use of tools and without the necessity of providing a mattress retainer bar attachment kit. In an embodiment, the system includes a set of attachment blocks that are attached to the mattress support before shipping to the consumer. The system also includes a mattress retainer bar that is configured to slide over the mattress retainer blocks such that the mattress retainer bar can be removably affixed to the mattress support without the use of tools or additional hardware.

Further embodiments of the present invention provide an adjustable bed having mattress retainer bar attachment blocks that locate and secure a mattress retainer bar on the mattress support. The attachment blocks include a throughway that acts as a guide, support, and anchor for the free end of a U-shaped end portion of a mattress retainer bar. The attachment blocks further include a stop surface configured to prevent the curved portion of the U-shaped end portion from sliding forward any further, thereby securely fastening the mattress retainer bar against the outward pressure of the mattress.

These and other aspects of the invention will become apparent to one of ordinary skill in the art upon a reading of the following description, drawings, and the claims.

BRIEF DESCRIPTION OF THE DRAWINGS

The present invention is described in detail below with reference to the attached drawing figures, wherein.

DETAILED DESCRIPTION

Figure 1:
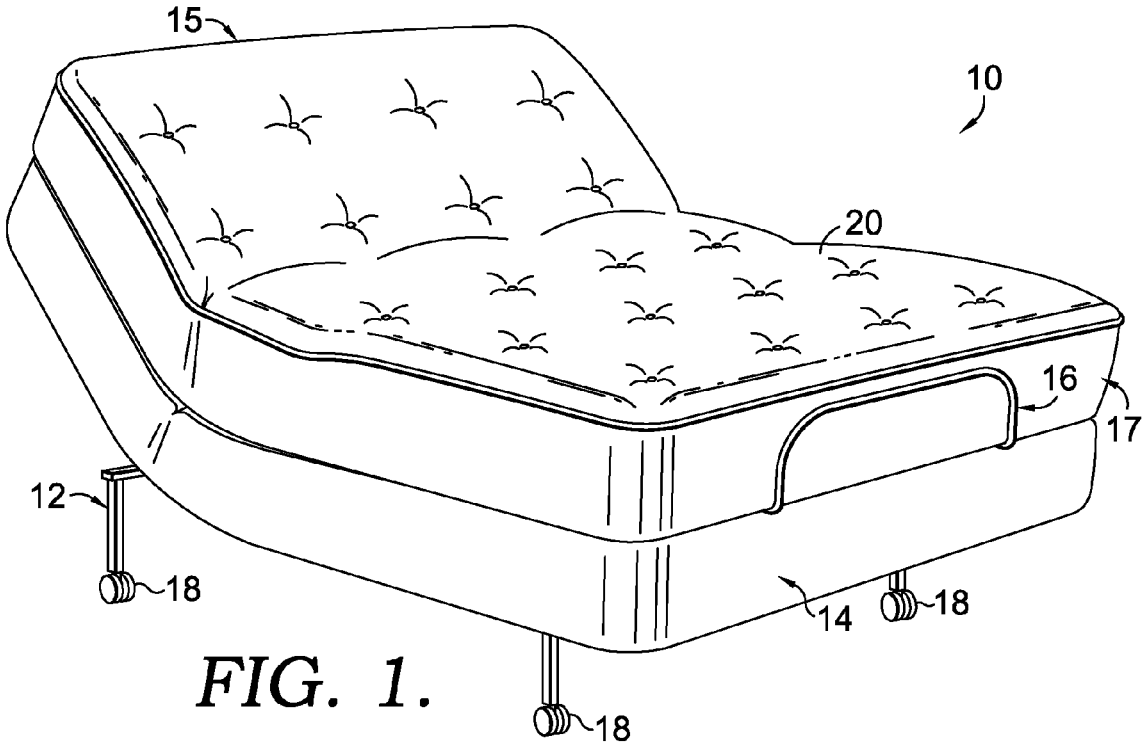
FIG. 1 is a perspective view, showing an adjustable bed with an exemplary mattress retainer bar attachment system in accordance with an embodiment of the present invention.

Referring to the drawings, and particularly to FIG. 1, there is illustrated an adjustable bed 10 in accordance with an embodiment of the present invention. The adjustable bed 10 includes a bed frame 12, an adjustable mattress support 14 disposed on an upper portion of the frame 12, and an exemplary mattress retainer bar 16 in accordance with an embodiment of the present invention. The adjustable bed 10 includes a head end 15 and a foot end 17. Casters 18 may be provided on the frame 12 to facilitate repositioning the adjustable bed 10 within a room. A mattress 20 is disposed on the mattress support 14.

Figure 2:
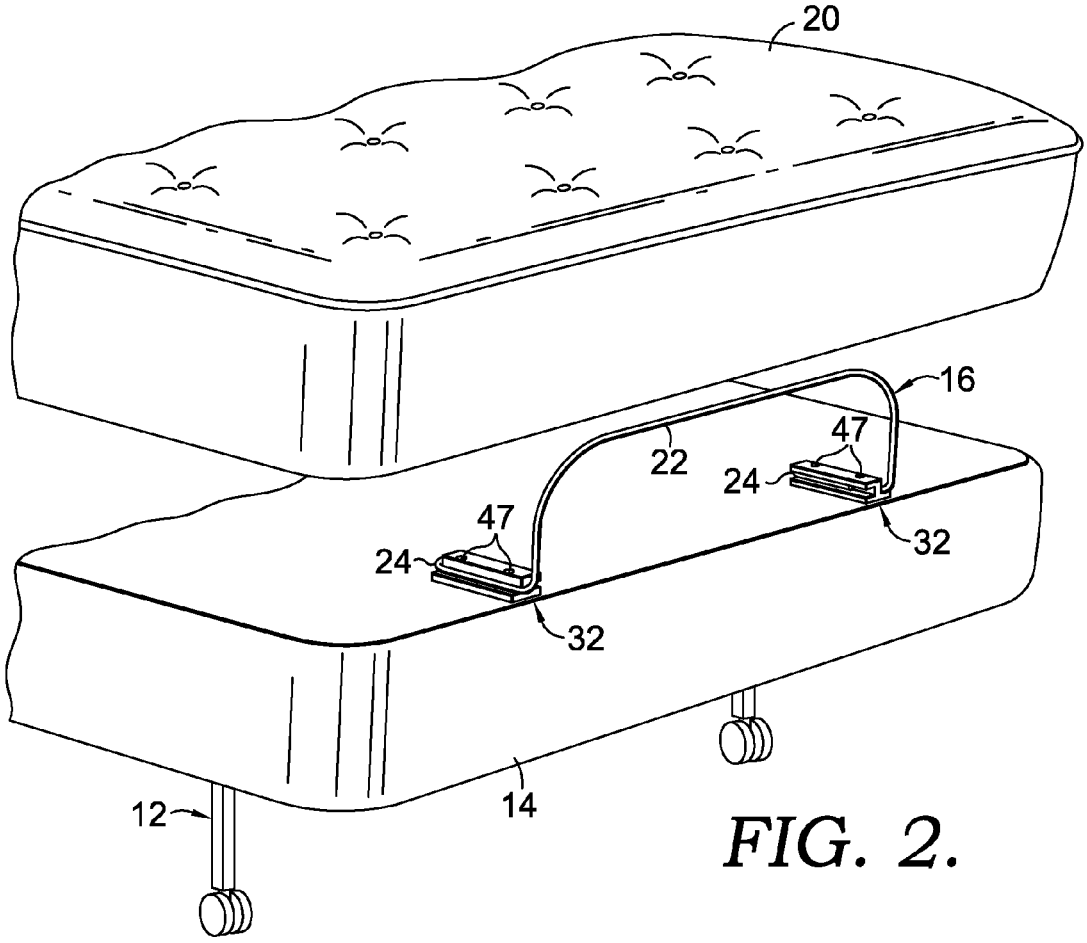
FIG. 2 is an enlarged partial perspective view of an adjustable bed with an exemplary mattress retainer bar attachment system in accordance with an embodiment of the present invention and shown with the mattress elevated to provide a view of the attachment system.
Figure 3:
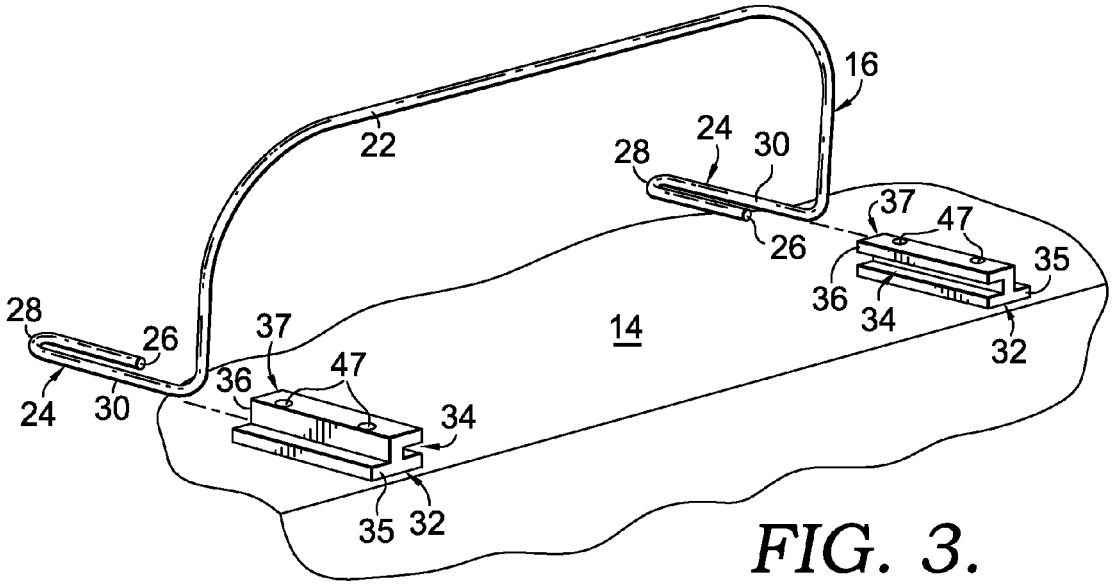
FIG. 3 is an enlarged partial perspective view of a mattress retainer bar attachment system showing installation of a mattress retainer bar thereon in accordance with an embodiment of the present invention.

With continued reference to FIG. 1 and referring further to FIGS. 2 and 3, a mattress retainer system is illustrated and includes a mattress retainer bar 16 that is attached to the mattress support 14. The mattress retainer bar 16 includes an upright mattress retaining portion 22 that is configured to engage the foot edge of the mattress 20 to constrain the position of the mattress 20 on the mattress support 14 when various portions of the mattress are raised and/or lowered to desired positions. For example, as shown in FIG. 1, the head end 15 is shown in a raised position. In this position, the foot end 17 has a tendency to move forward without the retainer bar 16. Thus, the retainer bar 16 functions to maintain the mattress 20 in place with respect to mattress support 14. More specifically, the mattress retaining portion 22 prevents the mattress 20 from sliding off of the foot end of the mattress support 14 when the head of the adjustable bed 10 is raised. The mattress retainer bar 16 further includes a pair of U-shaped end portions 24 used to attach the mattress retainer bar 16 to the mattress support 14.

As shown in FIG. 3, the U-shaped end portions 24 of the mattress retainer bar 16 each include a free end 26, a curved portion 28, and an attached end 30. Turning to FIGS. 2 and 3, a pair of mattress retainer bar attachment blocks 32 are attached to the mattress support 14. Each of the attachment blocks 32 are attached to the mattress support 14 using screws that are driven through a pair of holes 47 disposed near the center of each attachment block 32. In an embodiment, the attachment blocks 32 may be attached to the mattress support 14 before the adjustable bed 10 is provided to a consumer, thereby limiting the complexity of assembly required by the consumer.

The attachment blocks 32 are configured such that the mattress retainer bar 16 can be removably attached to the mattress support 14 by sliding the U-shaped portions 24 onto the attachment blocks 32. As shown in FIG. 3, each attachment block 32 includes a throughway 34 extending between a first end 35 and a second end 37 of the attachment block 32 and adapted to receive, guide, and support the free end 26 of the U-shaped portion 24 of the mattress retainer bar 16. Each attachment block 32 also includes a stop-surface 36 configured to prevent the curved portion 28 of the U-shaped end portion 24 from sliding past the stop-surface 36, thereby providing a force that opposes the force of the mattress pushing forward against the mattress retainer bar 16. Advantageously, when a consumer receives an adjustable bed 10 having attachment blocks 32 already installed, the consumer can attach the mattress retainer bar 16 simply by sliding the retainer bar 16 onto the attachment blocks 32. Such an installation does not require additional hardware, the use of tools, or complex assembly instructions.

Figure 4:
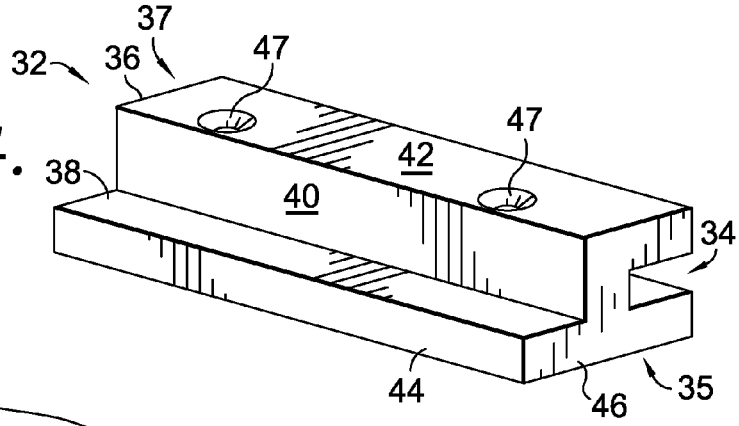
FIG. 4 is an enlarged perspective view of an illustrative mattress retainer bar attachment block in accordance with an embodiment of the present invention.

Turning now to FIG. 4, an exemplary attachment block 32 is illustrated. The attachment block 32 includes a throughway 34, a stop-surface 36, and a support surface 38. The throughway 34 is defined by a void bordered by a center wall 40, an upper wall 42 which extends perpendicularly outward in a first direction from an upper portion of the center wall 40 and a lower wall 44 which extends perpendicularly outward in the first direction and in an opposite direction from a lower portion of the center wall 40. The throughway 34 is adapted to receive and support a free end of a U-shaped end portion of a mattress retaining bar. The stop-surface 36 is adapted to engage at least a part of the curved portion of the U-shaped end portion of the mattress retaining bar. The support surface 38 is adapted to provide support for the attached end of the U-shaped end portion of the mattress retainer bar. Furthermore, the center wall 40 includes two holes 47 that are each configured to receive a screw therethrough that secures the attachment block 32 to the mattress support.

In embodiments, attachment block 32 can be made from plastics, wood, or metals. Additionally, the attachment block 32 can be produced as a molded, machined, or extruded component. Moreover, the attachment blocks 32 depicted in FIG. 3 can be similar or identical to one another, but oriented in an opposed fashion such that the throughways 34 of both blocks 32 are positioned toward the inside of the adjustable bed 10. Therefore, the attachment block 32 illustrated in FIG. 4 may include an alternative stop-surface 46 if the attachment block 32 is installed such that the curved portion of the U-shaped end portion of the mattress retainer bar engages the alternative stop-surface 46. In this way, numerous attachment blocks 32 can be manufactured using a single mold or cutting shape and can be replaced or exchanged without concern as to which side of the mattress support 14 the block 32 is to be installed on.

Figure 5:
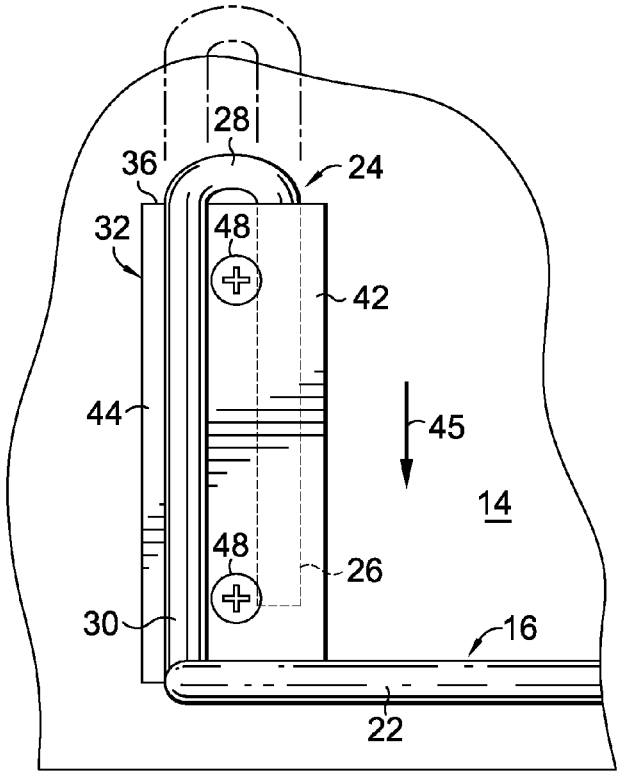
FIG. 5 is a top view of a mattress retainer bar attachment block engaging a U-shaped end portion of a mattress retainer bar in accordance with an embodiment of the present invention.

Referring to FIG. 5, a top view of an illustrative attachment block 32 is shown in operation. The attachment block 32 is secured to a mattress support 14 by two screws 48 driven through holes in a center wall (not shown in FIG. 5). The attachment block 32 further includes an upper wall 42 extending perpendicularly away from an upper portion of the center wall, and a lower wall 44 extending perpendicularly away from a lower portion of the center wall. A mattress retainer bar 16 is illustrated as being removably attached to the mattress support 14 using the attachment block 32.

The mattress retainer bar 16 includes a mattress retaining portion 22 and a U-shaped end portion 24, which includes a free end 26, a curved portion 28, and an attached end 30. As the mattress retainer bar 16 slides onto the attachment block 32 in the direction of the arrow 45, the free end 26 of the U-shaped end portion 24 is received and supported by a throughway 34, which is defined in part by the center wall, the upper wall 42, and the lower wall 44. The attached end 30 of the U-shaped end portion 24 is supported on the lower wall 44. The U-shaped end portion 24 continues to slide onto the attachment block 32 until the curved portion 28, or at least a part of the curved portion 28, engages the stop-surface 36. In this manner, when a mattress is installed on the mattress support 14, the mattress can press against the mattress retaining portion 22 toward the foot of the adjustable bed 10 and the mattress retaining bar 16 will hold the mattress in place.

Figure 6:
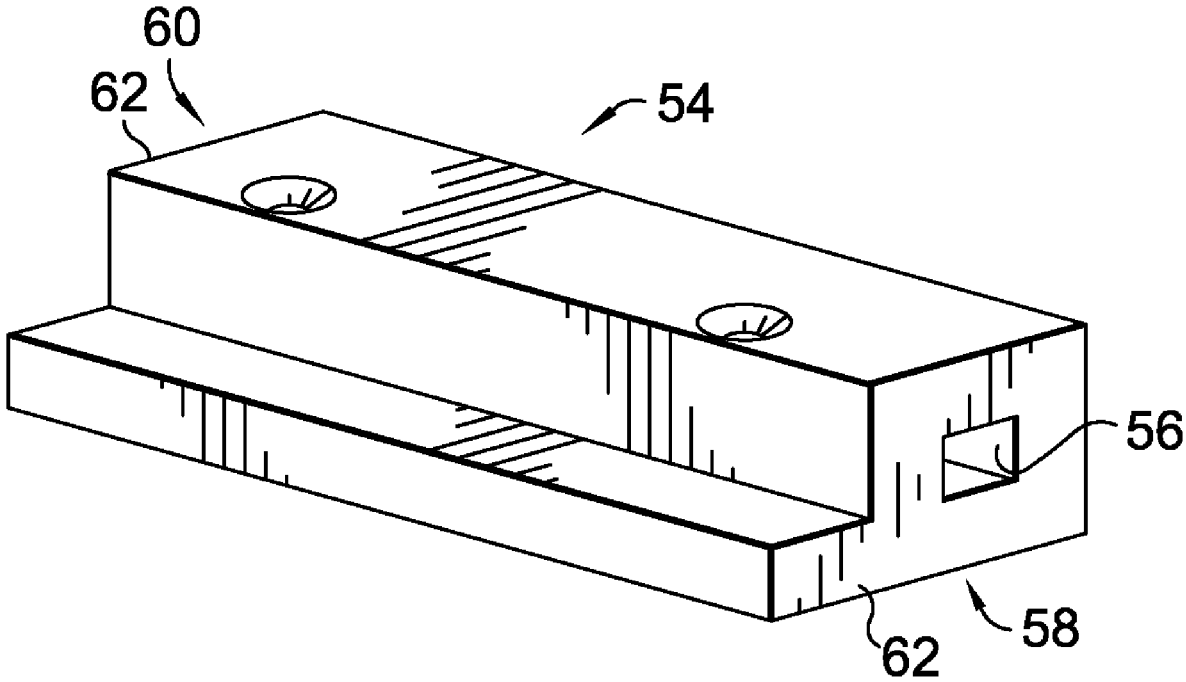
FIG. 6 is a perspective view of an exemplary mattress retainer bar attachment block in accordance with an embodiment of the present invention.

The present invention has been described in relation to particular embodiments, which are intended in all respects to be illustrative rather than restrictive. Alternative embodiments will become apparent to those of ordinary skill in the art to which the present invention pertains without departing from its scope. For example, in one embodiment, as illustrated in FIG. 6, the attachment block 54 can be constructed such that the throughway 56 is defined by a hole extending from a first end 58 of the block 54 to a second end 60 of the block 54. Because the attachment block 54 can be rotated for attachment to an opposite side of a mattress, the attachment block 54 has two potential stop-surfaces 62. Additionally, other configurations that provide for a throughway and a stop-surface as described herein are considered to be within the ambit of the present invention.

From the foregoing, it will be seen that this invention is one well adapted to attain all the ends and objects set forth above, together with other advantages which are obvious and inherent to the system. It will be understood that certain features and subcombinations are of utility and may be employed without reference to other features and subcombinations. This is contemplated by and is within the scope of the claims.

What is claimed is:

1. An adjustable bed having a head end and a foot end, the bed comprising:

a bed frame having a mattress support disposed on an upper portion thereof;

a pair of attachment blocks secured to the mattress support near the foot end of the bed; and a mattress retainer bar comprising a mattress retaining portion and a pair of U-shaped end portions that are roughly perpendicular to the mattress retaining portion and that are adapted to engage the attachment blocks, thereby positioning the mattress retainer bar such that the mattress retaining portion extends upward with respect to the mattress support and is adapted to engage a foot end of a mattress disposed on the mattress support to prevent the mattress from sliding off of the mattress support during articulation of the head end of the bed.

2. The adjustable bed of claim 1, wherein each of the attachment blocks comprises a throughway and a stop-surface configured such that a free end of a U-shaped end portion is received by the throughway and a curved portion of the U-shaped end portion engages the stop-surface.

3. The adjustable bed of claim 2, wherein the throughway is defined by a void bordered by a center wall, an upper wall which extends perpendicularly outward in a first direction from an upper portion of the center wall and a lower wall which extends perpendicularly outward in at least the first direction from a lower portion of the center wall.

4. The adjustable bed of claim 2, wherein the throughway is defined by a hole extending from a first end of the attachment block to a second end of the attachment block.

5. The adjustable bed of claim 1, wherein the attachment block comprises an extruded plastic form.

6. The adjustable bed of claim 1, wherein the mattress retainer bar can be attached to the mattress support via the attachment blocks without requiring the use of tools.

7. An adjustable bed having a head end and a foot end, the bed comprising:

a mattress support disposed on a bed frame;

a mattress retainer bar having an upright mattress retaining portion and a U-shaped end portion at each end of the mattress retainer bar, each U-shaped end portion being roughly perpendicular to the upright mattress retaining portion; and an attachment block secured to the mattress support, the attachment block comprising a throughway extending between a first and second end of the attachment block and running parallel to the surface of the mattress support, and adapted for receiving a free end of the U-shaped end to removably couple the retainer bar to the mattress support, thereby positioning the mattress retainer bar between the attachment blocks such that the mattress retaining portion can engage a foot end of a mattress disposed on the mattress support to prevent the mattress from sliding off of the mattress support.

8. The adjustable bed of claim 7, wherein the attachment block further comprises a stop surface that is roughly parallel to the mattress retaining portion and that is adapted to engage a curved portion of the U-shaped end portion.

9. The adjustable bed of claim 7, wherein the attachment block further comprises a lower wall that extends roughly perpendicularly away from a lower portion of a center wall and is adapted to support an attached portion of the U-shaped end portion of the mattress retainer bar.

10. The adjustable bed of claim 7, wherein the throughway is defined by a void bordered by a center wall, an upper wall which extends perpendicularly outward in a first direction from an upper portion of the center wall and a lower wall which extends perpendicularly outward in at least the first direction from a lower portion of the center wall.

11. The bed of claim 7, wherein each of the attachment blocks is attached to the mattress support by at least one screw that passes through a center wall and engages the mattress support.

12. The bed of claim 7, wherein the mattress retainer bar is adapted to be installed without the use of tools.

13. A mattress retainer system adapted to maintain a position of a mattress on a mattress support, the system comprising:

a pair of attachment blocks secured to the mattress support and adapted for receiving a corresponding pair of U-shaped end portions of a mattress retainer bar, the attachment blocks each having a center wall oriented so that the center wall is roughly perpendicular to the mattress support, an upper wall which extends perpendicularly outward in a first direction from an upper portion of the center wall and a lower wall which extends perpendicularly outward in the first direction from a lower portion of the center wall, such that a void bordered by the center wall, lower wall, and upper wall comprises a throughway adapted to receive a free end of a U-shaped end portion of a mattress retainer bar such that the mattress retainer bar engages a side of a mattress disposed on top of the mattress support.

14. The adjustable bed of claim 13, wherein the mattress retainer bar further comprises a mattress retaining portion that is adapted to engage the side of the mattress.

15. The adjustable bed of claim 14, wherein the attachment block further comprises a stop-surface that is roughly parallel to the mattress retaining portion and that is adapted to engage a curved portion of the U-shaped end portion.

16. The adjustable bed of claim 15, wherein the lower wall also extends in a second direction from a lower portion of the center wall and is adapted to support an attached portion of the U-shaped end portion.

17. The adjustable bed of claim 13, wherein each of the attachment blocks is attached to the mattress support by at least one screw that passes through the center wall and engages the mattress support.

18. The adjustable bed of claim 13, wherein each of the attachment blocks comprises an extruded plastic form.

19. The adjustable bed of claim 13, wherein each of the attachment blocks are substantially similar in construction.

20. The adjustable bed of claim 13, wherein the mattress retainer bar is adapted to be installed without the use of tools.

* * * * *